US005077943A

United States Patent [19]

McGady

[11] Patent Number: 5,077,943

[45] Date of Patent: Jan. 7, 1992

[54] CORNER FLASHING

[76] Inventor: Donald L. McGady, 7827 Pine Pkwy., Darien, Ill. 60559

[21] Appl. No.: 742,072

[22] Filed: Aug. 7, 1991

Related U.S. Application Data

[63] Continuation of Ser. No. 554,356, Jul. 19, 1990, abandoned.

[51] Int. Cl.[5] ..... E04D 13/14

[52] U.S. Cl. ..... 52/58; 52/219

[58] Field of Search ..... 52/58, 60, 62, 219

[56] References Cited

U.S. PATENT DOCUMENTS 4,603,517 8/1986 Lyons, Jr. ..... 52/219

4,700,512 10/1987 Laska ..... 52/58

FOREIGN PATENT DOCUMENTS 3603303 8/1987 Fed. Rep. of Germany ..... 52/219

OTHER PUBLICATIONS

Chapter 8, pp. 21-37, "Residential Asphalt Roofing Manual", Asphalt Roofing Manufacturer's Association, 1800 Massachusetts Avenue, Washington, DC 20036, copyright 1980.

*Primary Examiner*—Richard E. Chilcot, Jr.

*Assistant Examiner*—Joanne C. Downs

*Attorney, Agent, or Firm*—Hill, Van Santen, Steadman & Simpson

[57] ABSTRACT

Corner flashing for the roof line at intersections of the roof surfaces with upstanding walls or projections such as dormers, chimneys, and the like is provided to fit, without cutting, the roof line of widely varying inclinations and embrace the corners of the projections above the roof line without opening a possible leakage path. The flashing is preferably a molded one-piece plastics material member with a base for seating on the roof deck and underlying the roofing material to radiate from the corner of an upstanding projection above the roof line and having integral upstanding substantially right angle sides for abutting the area on both sides of the projection and with the corner of the sides being foldable to form a tuck overlying one of the sides to pull both sides into tight abutting engagement with the projection. The tuck may overlap either side of the upstanding side and be secured to the upstanding projection by a nail or the like. The resulting tucked configuration seals a corner of the projection without opening any leakage path.

14 Claims, 2 Drawing Sheets

CORNER FLASHING

This is a continuation of application Ser. No. 554,356, filed July 19, 1990, now abandoned.

BACKGROUND OF THE INVENTION

1. Field of the Invention

This invention relates to the art of preventing leakage between roofing and upstanding projections such as dormers and chimneys at the corners of the projection and specifically deals with a molded plastics material flashing member having a base seated on the roof deck to radiate from both sides of the corner of a projection above the deck and having an upstanding two-sided corner for abutting the areas adjacent the corner of the projection which are adapted to be folded in either direction to form a tuck overlapping one of the sides to cause both sides to tightly embrace the projection without opening up a leakage path along the roof line.

2. Description of the Prior Art

Heretofore, experienced roofers or tinsmiths were required to cap the corners of projections such as dormers or chimneys above the roof line to provide on the job custom fitted flashing pieces attempting to seal the corner at the roof line. These hand cut or trimmed flashing pieces always leave a gap or hole at the corner through which water may seep.

It would therefore be an improvement in this art to provide a pre-fabricated flashing member fitting all types of roof lines and corners of projections above the roof lines without opening up any leakage path between the corner of the projection and the adjacent roof.

It would be a further improvement in this art to provide a corner flashing member with a base fitting a roof deck of any inclination to be covered by roofing shingles or the like roofing material and having upstanding integrally connected corner sides for overlapping the adjacent sides of the corner of a projection and adapted to be lapped to form a tuck causing the upstanding sides to tightly embrace the corner of the projection.

SUMMARY OF THE INVENTION

According to this invention, a one-piece molded plastics material corner flashing member is provided with a flat base and an upstanding two-sided corner that is bendable to form a tuck causing the both sides to tightly embrace the corner of a projection above a roof regardless of the angle of inclination of the roof relative to the projection. The tuck is formed by overlapping one of the sides at the corner between the sides. Then when the base lies flat on an inclined roof deck at the corner of a projection such as a chimney, wall, dormer or the like above the deck, the upstanding sides of the corner of the base will embrace the corner of the projection and when the tuck is formed, the sides will tightly hug the adjacent sides of the corner without opening up a leakage path between the roof deck and corner of the projection.

This invention will be further understood by those skilled in this art from the attached drawings of a best mode embodiment of the invention and the following descriptions of the drawings.

IN THE DRAWINGS

AS SHOWN ON THE DRAWINGS

Figure 1:
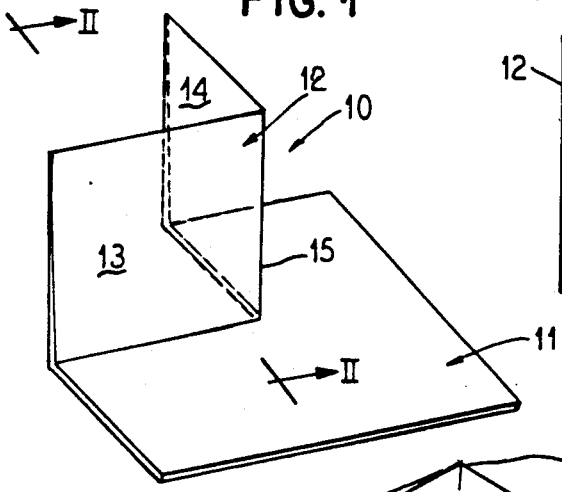
FIG. 1 is a perspective view of a corner flashing invention.
Figure 2:
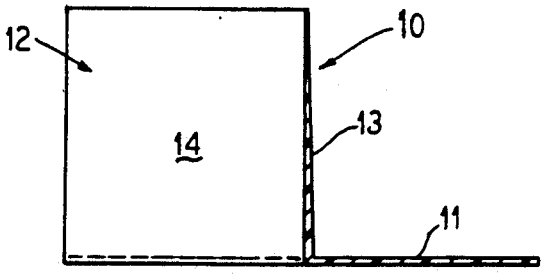
FIG. 2 is a cross-sectional view along the line II—II of FIG. 1.

As illustrated in FIGS. 1 and 2, the corner flashing 10 of this invention is a one-piece member, preferably composed of a bendable molded plastics material such as polypropylene. The flashing 10 has a base 11, preferably of square or rectangular shape with a integral upstanding corner 12 having a pair of sides 13 and 14 in right angled relation and integrally joined at a corner 15. The upstanding corner 12 is substantially in right angle relation with the base 11.

As shown in FIG. 1, the base 11 is rectangular with parallel top and bottom edges and parallel opposite sides intersecting at corners. The upper left-hand corner of this base 11 is notched out to provide a rectangular recess with a first edge extending from the upper edge of the base parallel to the sides of the base and with a second edge extending from one side edge toward the other side edge and parallel with the top and bottom edges. These edges of the rectangular recess intersect at a corner spaced from the top, bottom and side edges of the base. The upstanding corner 12 has its corner 15 rising from the corner of the rectangular recess and its side 13 rising from the edge of the recess that is parallel to the top and bottom edges of the base while its side 14 rises from the edge of the recess that is parallel to the side edges of the base.

Thus the upstanding corner 12 forms a continuous junction with the base member that is coextensive with the recess, and the base 11 is "L"-shaped with leg portions radiating from sides 13 and 14 of the upstanding corner 12.

The flashing 10 is conveniently formed with an 8×8" base and a 4×4" upright corner. These dimensions can be varied to suit conditions, with the base, for example, being increased to a 10×10" size and the corner being decreased to a 3×3" size. The dimensions should be sufficient to provide a base covering a substantial area of a roof deck adjacent the corner of the chimney or dormer projection and to cover a substantial area of the sides of the corner of the projection.

The flashing 10 may have a thickness of ⅛ to ¼" and should be sufficiently flexible or bendable to conform with the corner to be sealed regardless of the inclination of the base 11 when bottomed on a roof deck.

Figure 3:
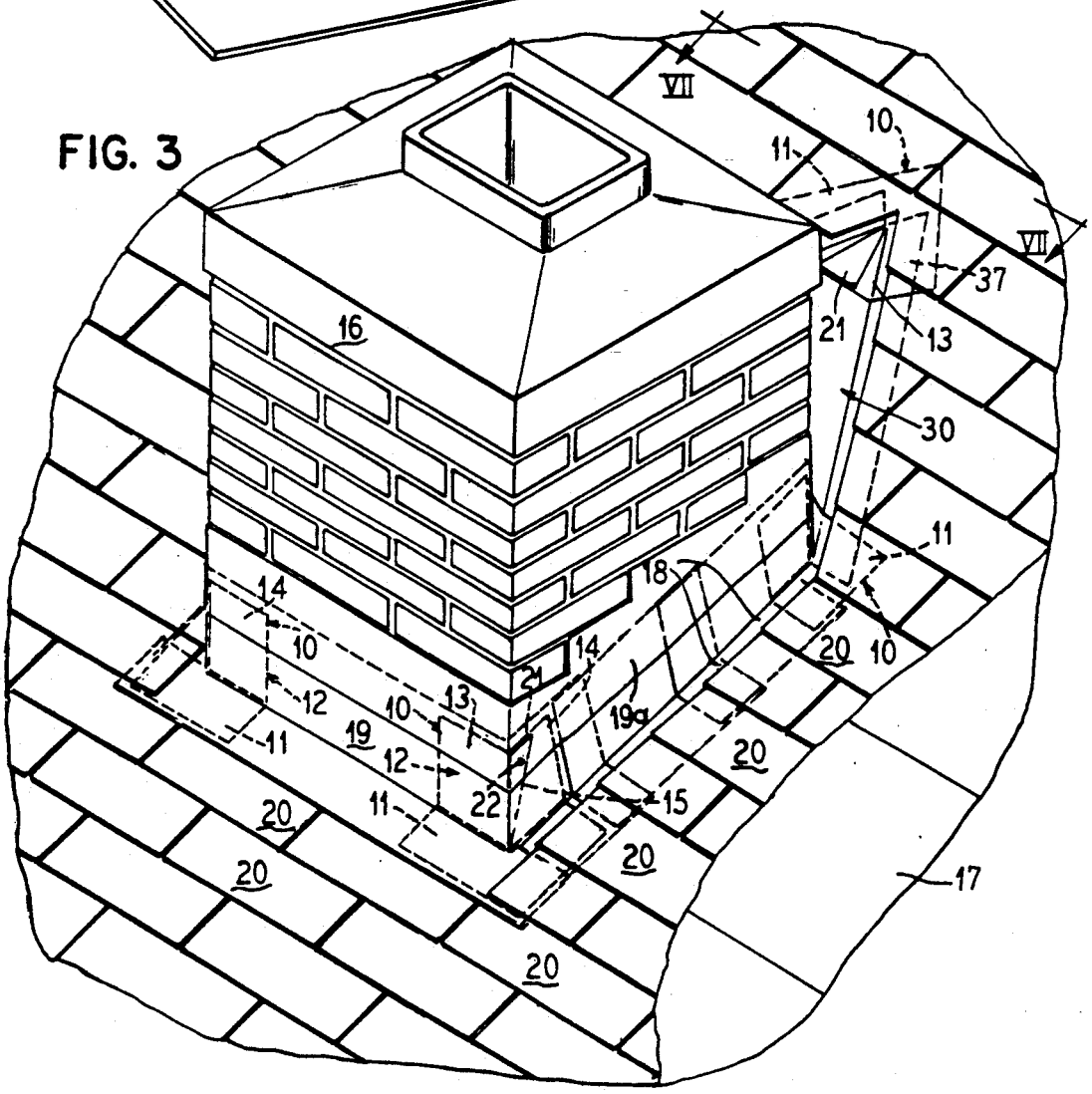
FIG. 3 is a perspective view showing installations of the corner flashing of this invention on a roof and chimney construction.

As shown in FIG. 3, the flashing 10 is applied to the lower corners of a chimney 16 at an inclined roof deck 17 with the base 11 of the flashing 10 mounted on the deck to extend laterally and below the chimney.

Right angled metal flashing strips or "baby tins" 18 are mounted on the roof deck 17 and extend in overlapped relation from the top to the bottom of the side walls of the chimney with their upstanding sides covering these sides of the chimney at the roof line for a distance of about 3–5". An overlying cap flashing strip 19*a* can also overlie the upstanding sides of the strips 18 on the chimney.

The front face of the chimney is covered by a single strip of right angled flashing 19 mounted on the adjacent roof deck.

The upstanding sides 13 and 14 of the corner flashing 10 may overlie or underlie the flashing strips 18 and 19 at the corner. Roof shingles 20, applied in the conventional overlapping relation o the deck 17 cover the horizontal or deck sides of the flashings 18 and 19 and the bases 11 of the corner strips and extend up to the roof line intersectioned with the chimney. Other conventional roofing material can be used in place of the shingles 20.

Since the roof deck 17 on which the base 11 of the bottom corner flashings are mounted, as shown, slopes downwardly relative to the chimney 16, the roof deck mounted base 11 of the right-hand bottom corner flashing 10 will be inclined and the side 13 of the upstanding corner 12 will be inclined away from the flashing 10 while the side 14 tightly abuts the flashing 18. Therefore, to draw the side 13 into tight abutment with the flashing 19, the corner 15 between the sides 13 and 14 is bent over the side 14 to form a tuck 21. This tuck 21 overlaps the side 14 and is secured in position by a fastener, such as a nail 22 driven through the top end of the tuck into the chimney. The left-hand bottom corner flashing will have the side 14 of the corner tilted away from the flashing 19 and therefore the tuck is formed to draw it against flashing 19.

Figure 4:
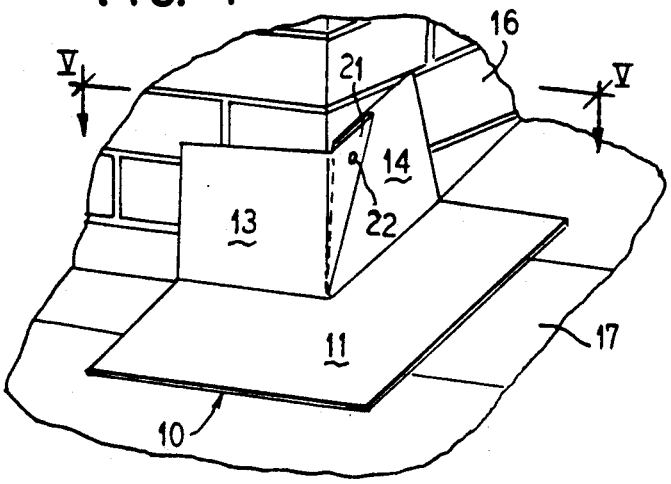
FIG. 4 is a perspective view of the corner flashing of this invention applied to a right-hand bottom corner of a chimney at its intersection with an inclined roof deck.
Figure 5:
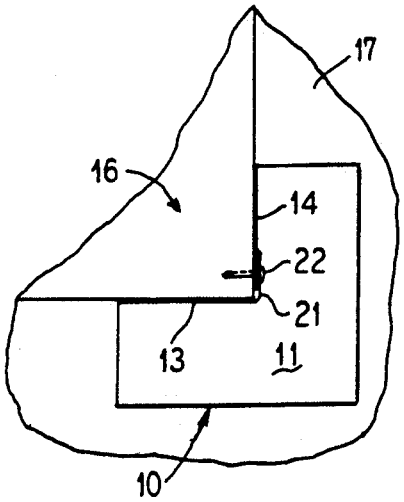
FIG. 5 is a top plan view along the line V—V of FIG. 4.

As shown in FIGS. 4 and 5, the tuck 21 overlaps the side 14 to be nailed to the side wall of the chimney 17. Alternately, the tuck could overlap the side wall 13 to be secured to the front or bottom end wall of the chimney 17.

Figure 6:
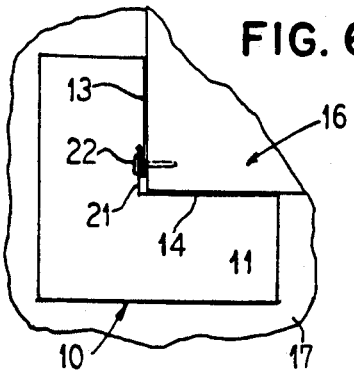
FIG. 6 is a view similar to FIG. 5 but showing the corner flashing applied to the left-hand corner of the chimney at the roof deck.

In FIG. 6 the corner flashing 10 is shown as covering the lower left-hand corner of the chimney. In this arrangement, the side wall 13 overlies the opposite side wall of the chimney while the side 14 overlies the front or bottom end wall of the chimney. The corner flashing 10 covering the left-hand corner of the chimney is rotated 90° from the position covering the right-hand corner of the chimney.

The tuck 21 can be turned to overlie either side 13 or 14.

As shown in FIGS. 4–6 the corner of the chimney 16 fits in notched out corner or recess of the base 11 and the legs of the "L"-shaped base radiate from this recess A as shown in FIG. 3 when the corner flashing members 10 are used in shingle roofed installations, this base 11 can be bottomed on an underlying shingle 20, covered by the overlying shingle and radiate from the chimney corner while the walls 13 and 14 rising from the recess hug the bottom and side walls of the chimney at its corner.

From the illustrations of FIGS. 1–6, it should be understood that the lower corners of the chimney at the roof deck line are completely sealed relative to the roof so that water draining down the roof cannot leak through the roof. The molded corner flashing of this invention when properly installed as described above, does not open up any hole or leakage gap. For sealing upper corners of the chimney, the flashing 10 can be made flexible enough to bend the base 11 at the intersection of the base and upstanding sides 13 or 14 to accommodate the upstream roof line so that the sides abut the chimney. However, it is preferred to provide a "cricket" or saddle above the top end wall of the chimney for diverting water around the chimney especially if the chimney is surrounded by roofing. If the chimney construction extends beyond the roof, a flashing 10 need only be used at the two corners of the roof-chimney intersection.

Figure 7:
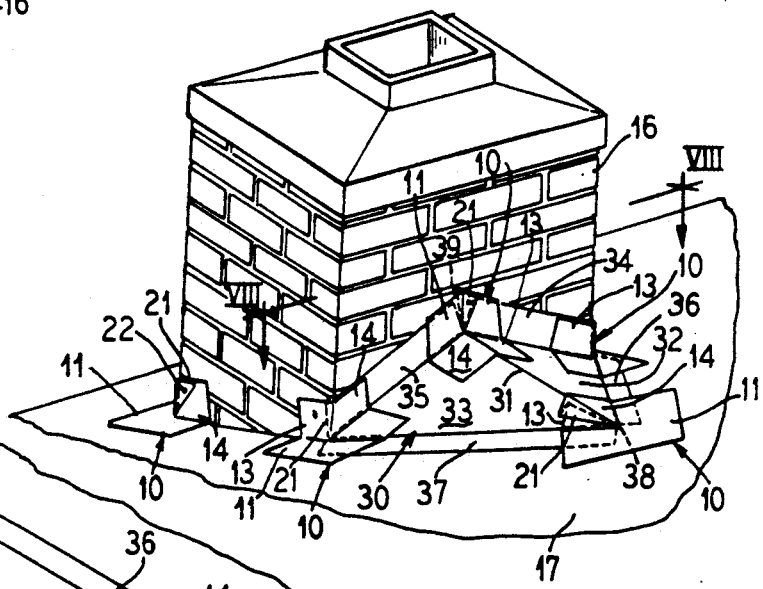
FIG. 7 is a perspective view from the back or top end wall and roof of the chimney taken along the line VII—VII of FIG. 3 and illustrating the manner in which the flashing of this invention is useful in sealing saddle constructions for diverting water flow around the chimney.
Figure 8:
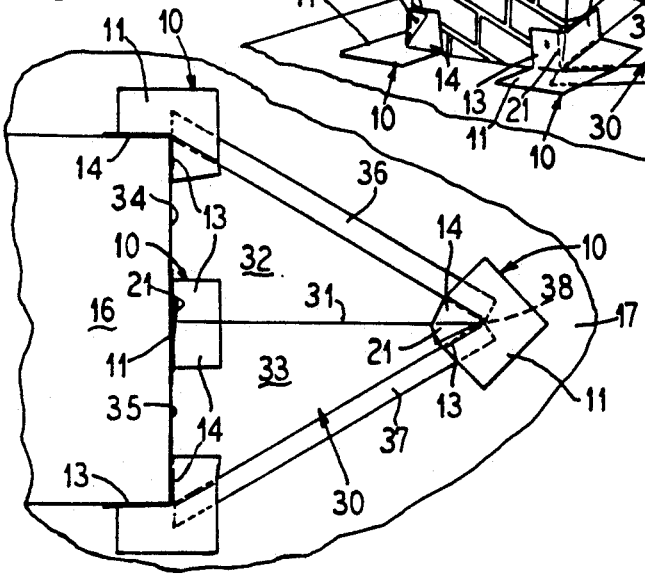
FIG. 8 is a plan view along the line VIII—VIII of FIG. 7.

As shown in FIGS. 7 and 8, the flashing 10 of this invention is useful to seal corners of a water diverting "cricket" or saddle conventionally used to divert water from the top side end wall of the chimney to the sides of the chimney at the roof line.

As shown in FIGS. 7 and 8, a conventional saddle 30 is mounted on the roof deck 17 behind the top end wall of the chimney. This saddle is usually a metal hollow box-like member or a wood frame covered with shingles and laced with "baby tin" metal flashing strips with a top edge or ridge 31 from which a first inclined 32 side diverts water to one side of the chimney 16 while a second inclined side 33 diverts water to the opposite side wall of the chimney. The sides 32 and 33 have upstanding flashing flanges 34 and 35 tightly abutting the top end wall of the chimney. The bottom edges of the inclined walls 32 and 33 can have integral or underlying flashing flaps 36 and 37 overlying the deck 17. The saddle 30 may be hand-trimmed to fit the roof deck and top wall of the chimney, but it will be noted that even with a carefully handcrafted saddle, corners of the saddle at the chimney and at the upper end of the saddle are exposed to leakage. In addition, a gap 38 between the flashing flanges 36 and 37 may permit leakage. These leakage paths can be stopped by the corner flashings 10 of this invention.

As shown in FIGS. 7 and 8, a flashing 10 has its base 11 mounted on the roof deck 17 immediately upstream from the gap 38 between the flashing portions 36 and 37 of the platform. Then the side walls 13 and 14 of its upstanding corner which project above the side walls 32 and 33 of the platform will be drawn into contact therewith when the tuck 21 is formed. As illustrated in FIGS. 7 and 8, the tuck 21 overlies the inclined wall 33 of the platform.

As also shown, a flashing 10 has its base 11 bottomed on the chimney covering the gap 39 between the flanges 34 and 35 with its sides 13 and 14 straddling the saddle ridge 31 and bottomed on the inclined sides 32 and 33 of the saddle 30. A tuck 21 is formed in the base to conform the sides 13 and 14 with the inclined sides 32 and 33 of the saddle 30 which are not in right angle relation.

The flashings 10 also close any leakage paths between the bottom ends of the flashing flanges 34 and 35 where each flashing 10 is with its base 11 on the deck 17 to present the upstanding corner of the base with its sides 13 and 14 respectively overlapping the flashing flanges 34 and 35 and the side walls of the chimney.

Fasteners 22 can anchor the tucks 21 of the corner flashings for the saddle 30 in the same manner as illustrated in FIGS. 4–6.

The tucks will cause the sides 13 and 14 to tightly abut the underlying portions of the saddle.

As illustrated in FIG. 3, the shingles 20 overlie the bases 11 of the flashings 10 and from the illustrations of FIGS. 3, 7 and 8, it should be understood that drainage of the inclined roof will be diverted around the top end wall of the chimney and will be sealed against leakage to the roof deck 17 by the flashings 10 of this invention which close up any gap between the flashing portions of the saddle and the roof deck.

From the above descriptions, it should be understood that this invention provides corner flashing for projections from roof decks which accommodate a wide range of inclined roof constructions without cutting or trimming and which is easily installed without opening up any leakage paths.

I claim as my invention:

1. Corner flashing for roof constructions having a roof covered with a plurality of adjacent courses of lapped roofing material and an upstanding corner construction projecting above the roof which comprises a one-piece impervious member having a flat rectangular base adapted to be sandwiched between adjacent courses of said roofing material with side and end edges intersecting at corners and having one corner notched out providing a rectangular recess with a first edge parallel to the side edges and a second edge parallel to the end edges of the base and intersecting at a corner inwardly from said end and side edges of the base, and upstanding pair of side walls integral with said base projecting from said first and second edges of the recess and connected at an upstanding integral corner at the intersecting corner of the edges of the recess, and said integral corner and side walls being bendable to form a tuck overlying either side wall to conform the side walls into abutting relation with the corner construction projection while the base is bottomed on the roof, whereby said corner flashing prevents leakage between said roof and said corner construction without the use of plastic sealants or adhesives.

2. The flashing of claim 1 wherein the upstanding pair of side walls are normal to the base and to each other.

3. The flashing of claim 1 wherein the base is square and the upstanding side walls are normal to the base at one of the corners of the square.

4. The flashing of claim 3 wherein the base is a square of about 8 to 10 inches and the upstanding side walls are about 3 to 5 inches high and wide.

5. A corner flashing member for an inclined roof covered with a plurality of adjacent courses of lapped roofing material and an upstanding corner projection above the inclined roof line which comprises a one-piece molded plastics member having a base adapted to be sandwiched between adjacent courses of said roofing material adjacent the corner projection, said base having a notched corner providing a recess, an upstanding portion on the base having a pair of side walls joined at a corner rising from, and forming a continuous junction with, the recess and adapted to overlap the corner of the roof projection when the base is mounted on the roof, and said corner of the upstanding side walls being bendable to overlap either of the side walls for drawing the side walls into abutment with the corner area of the projection, and said overlap adapted to receive a fastener therethrough to anchor the side walls to the projection, whereby said corner flashing prevents leakage between said roof and said corner projection without the use of plastic sealants or adhesives.

6. The flashing member of claim 5 wherein the plastics material is polypropylene about ⅛ to ¼ inches thick.

7. A corner flashing member for roof constructions covered with a plurality of adjacent courses of lapped roofing material and having a corner projection above the roof line which comprises a one-piece molded plastics material self-sustaining sheet member having a flat four-sided base adapted to be sandwiched between adjacent courses of said roofing material with two adjacent sides of the base notched out and providing a corner recess, and integral upstanding corner rising from said recess having two flat side walls in angular relation joined at an inner corner inwardly from the periphery of the base to overlie the corner projection when the base is bottomed on the roof, said inner corner being bendable to form a tuck lapping either side wall, and said tuck adapted to receive a fastener therethrough whereby when said base is bottomed on a roof construction to present the side walls of the upstanding corner to the sides of the corner projection the side walls are pulled by the tuck into abutment with the projection and the flashing member will prevent leakage between the roof and corner projection, whereby said corner flashing prevents leakage between said roof and said corner construction without the use of plastic sealants or adhesives.

8. The flashing member of claim 7 wherein the tuck is generally triangular.

9. The flashing member of claim 7 including a nail securing the tuck to the side walls and corner projection.

10. A corner flashing for use in roof constructions having a roof covered by adjacent courses of lapped roofing material and an upstanding corner construction projecting above the roof, said corner flashing comprising a one-piece impervious member including a generally flat base adapted to be sandwiched between adjacent courses of said lapped roofing material, an upstanding pair of side walls extending generally upwardly from said base to form an upstanding integral corner, said upstanding corner of said corner flashing being adapted to be conformed into abutting relation with the corner construction when said base is sandwiched between said adjacent courses of said lapped roofing material, whereby said corner flashing prevents leakage between said roof and said corner construction without the use of plastic sealants or adhesives.

11. A method of sealing corners of the sides of roof projections with a roof without the use of plastic sealants or adhesives, said roof having a deck and a lapped shingle roof covering made up of adjacent courses of shingles, which comprises providing a one-piece corner flashing member with a base having a recessed corner portion and upstanding bendable corner walls rising form the recessed portion, inserting the base between adjacent courses of the shingles of the roof covering adjacent the corner of the roof projection, positioning the bendable corner walls to embrace the sides of the corner of the projection, forming a tuck on the bendable corner walls drawing the corner walls into tight engagement with the sides of the corner projection, and lapping flashing strips with the shingles and bendable corner walls into cooperating relation therewith.

12. The method of claim 11 including the step of nailing the tuck to the roof projection.

13. The method of claim 11 including the step of pushing the base to bottom one corner wall on the projection and forming the tuck to bottom the other corner wall on the projection.

14. The method of claim 11 wherein the projection is a saddle behind a chimney on the roof and the corner flashing covers corners in the saddle on the roof.

* * * * *

UNITED STATES PATENT OFFICE
CERTIFICATE OF CORRECTION

Patent No. 5,077,943 Dated January 7, 1992

Inventor(s) Donald L. McGady

It is certified that error appears in the above-identified patent and that said Letters Patent is hereby corrected as shown below:

Column 1, lines 67-68, "...flashing invention." should be --flashing of this invention.---

Column 2, line 28, "a integral" should be --an integral--

Column 6, Claim 7, line 6, "and integral" should be --an integral--

Signed and Sealed this

Ninth Day of May, 1995

Bruce Lehman

*Attest:*

BRUCE LEHMAN

*Attesting Officer*

*Commissioner of Patents and Trademarks*